US007644988B2

(12) United States Patent
Kolenko

(10) Patent No.: US 7,644,988 B2
(45) Date of Patent: Jan. 12, 2010

(54) CHILD'S HIGHCHAIR WITH ACCESS ATTACHMENT

(76) Inventor: Raphael John Kolenko, 56 Fisher Crescent, Hamilton, Ontario (CA) L9C 4N2

( * ) Notice: Subject to any disclaimer, the term of this patent is extended or adjusted under 35 U.S.C. 154(b) by 0 days.

(21) Appl. No.: 12/045,102

(22) Filed: Mar. 10, 2008

(65) Prior Publication Data

US 2008/0231093 A1 Sep. 25, 2008

Related U.S. Application Data

(60) Provisional application No. 60/895,796, filed on Mar. 20, 2007.

(51) Int. Cl.
*A47C 7/62* (2006.01)
*A47B 83/02* (2006.01)

(52) U.S. Cl. ..... 297/217.1; 297/188.11; 297/153

(58) Field of Classification Search ..... 297/217.7, 297/188.11, 148–153, 217.1, 118; 182/33.4, 182/33.3, 33.5, 34, 206; D6/339
See application file for complete search history.

(56) References Cited

U.S. PATENT DOCUMENTS

| | | | | | |
|---|---|---|---|---|---|
| 740,460 | A | * | 10/1903 | Naylor | 182/159 |
| D161,792 | S | * | 1/1951 | Schilling | D6/335 |
| 2,584,742 | A | * | 2/1952 | Schilling | 182/129 |
| 2,669,285 | A | * | 2/1954 | Young | 182/33 |
| 2,673,601 | A | * | 3/1954 | Fischer et al. | 312/246 |
| 2,900,011 | A | * | 8/1959 | Casey | 297/411.28 |
| 2,919,748 | A | * | 1/1960 | Alden, Sr. | 297/153 |
| D248,599 | S | * | 7/1978 | Mears | D6/339 |
| 4,258,827 | A | | 3/1981 | Klose | |
| 4,557,350 | A | | 12/1985 | Wang | |
| D369,684 | S | * | 5/1996 | Engel et al. | D6/335 |
| 5,642,917 | A | * | 7/1997 | Geiger | 297/219.12 |
| 5,927,805 | A | * | 7/1999 | Hilger et al. | 297/239 |
| 6,142,565 | A | * | 11/2000 | Rieder | 297/219.12 |
| 6,840,583 | B1 | | 1/2005 | Turner et al. | |
| 7,210,737 | B2 | * | 5/2007 | Schaller | 297/170 |
| D559,018 | S | * | 1/2008 | Peoples et al. | D6/491 |

FOREIGN PATENT DOCUMENTS

| | | |
|---|---|---|
| CA | 210518 | 8/1920 |
| CA | 226708 | 3/1922 |
| CA | 236993 | 6/1923 |
| CA | 293685 | 8/1928 |
| CA | 343090 | 11/1930 |
| CA | 352116 | 8/1935 |
| WO | WO 9801060 A1 * | 1/1998 |

* cited by examiner

*Primary Examiner*—Milton Nelson, Jr.
(74) *Attorney, Agent, or Firm*—Connolly Bove Lodge & Hutz

(57) ABSTRACT

A highchair assembly includes a seat supported by a plurality of legs with an upstanding back wall and opposite first and second side walls. An access device is mounted to one of the side walls. The access device has an upper end located generally at the one side wall and the lower end for placement on a support surface. A child can enter and exit the highchair through use of the access device.

18 Claims, 6 Drawing Sheets

Fig. 6.
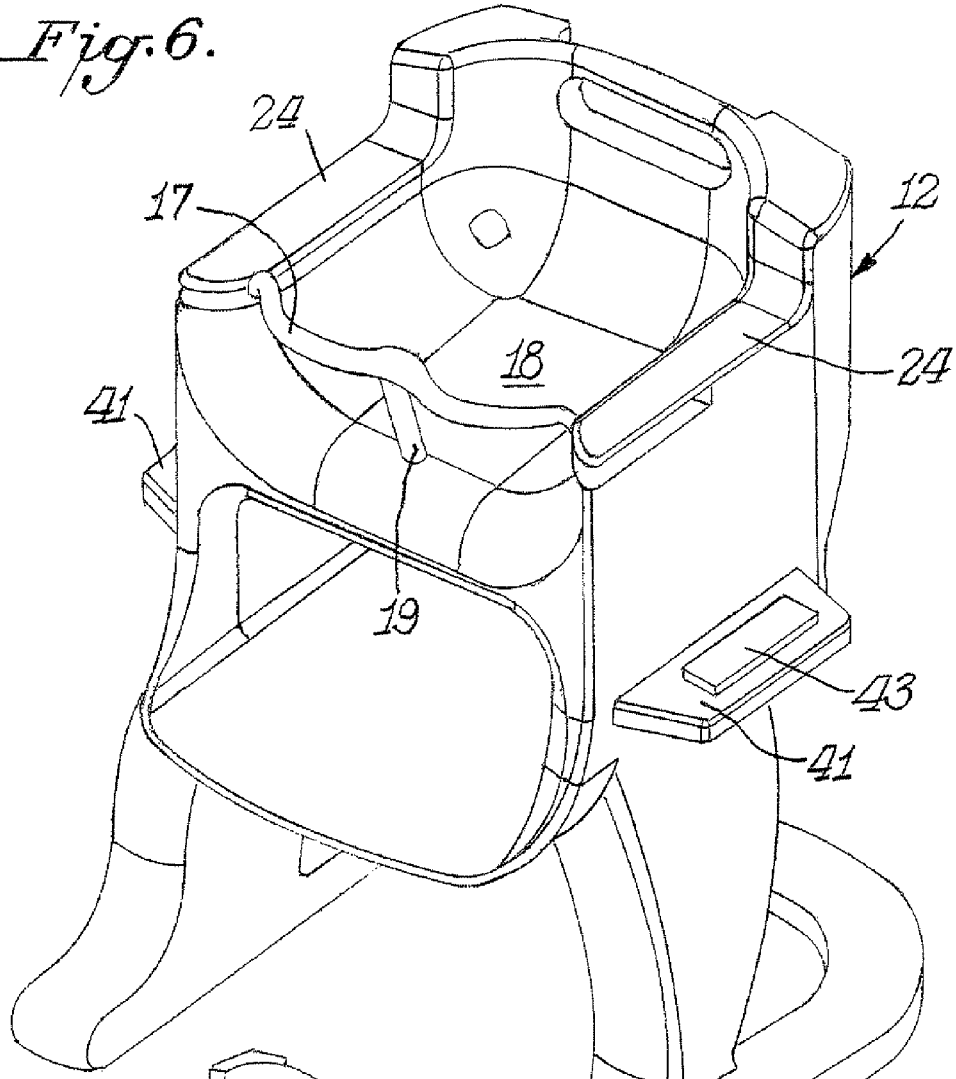
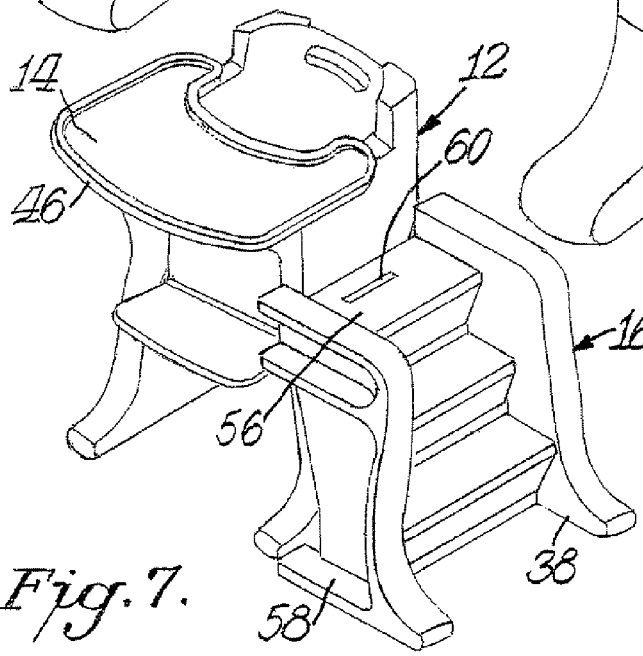
Fig. 7.

CHILD'S HIGHCHAIR WITH ACCESS ATTACHMENT

CROSS-REFERENCE TO RELATED APPLICATION

This application is based on provisional application Ser. No. 60/895,796 filed Mar. 20, 2007, all of the details of which are incorporated herein by reference thereto.

BACKGROUND OF INVENTION

Traditional highchairs tip easily and typically have many dangerous angles and steel bars. Children inherently attempt to climb into or out of their highchairs, shopping carts and so forth; this is why most of such devices have seating straps.

It would be desirable if a highchair could be provided that would safely permit a child to climb into or out of the highchair without rendering the highchair dangerous.

SUMMARY OF INVENTION

An object of this invention is to provide a child's highchair having an attached access device to readily permit a child to climb into and out of the highchair in a safe manner.

A further object of this invention is to provide such a device which adds to the stability of the highchair.

In accordance with this invention improvements are made to a highchair having a seat surrounded by an upstanding back wall and opposite first and second side walls. Preferably a tray is located at the front of the seat. In accordance with this invention an access device is mounted at one of the side walls. The access device has an upper end generally located at the one side wall and a lower end which would rest on the floor or support surface. By having the access device rest on the support surface there is added stability to the highchair to which the access device is connected.

In a preferred practice of this invention the access device is in the form of a set of steps which could be considered as a ladder having at least three steps. The device is preferably detachably mounted to the highchair so as to provide the option of permitting a child to independently get into and out of the highchair or to not have that option.

Preferably, the access device includes side rails which a child may grasp to facilitate use of the access device.

In an alternative practice of the invention the access device is a sliding board. Preferably the sliding board includes a generally horizontal platform at its upper end which would be detachably mounted to the highchair.

THE DRAWINGS

FIGS. 6-10 are perspective views of an alternative forms of highchairs in accordance with this invention;

DETAILED DESCRIPTION

Figure 1:
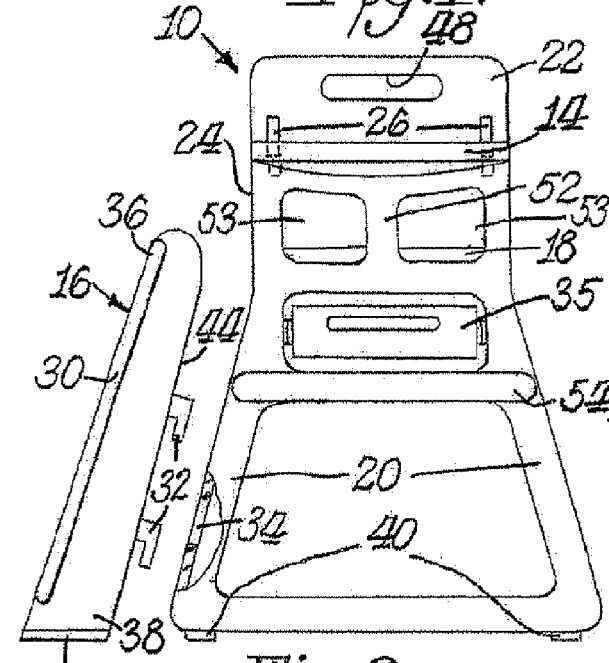
FIG. 1 is a front elevational view partly in section of a child's highchair with a detached access device in accordance with this invention.

FIGS. 1-4 illustrate a child's highchair assembly 10 in accordance with one practice of this invention. As shown therein assembly 10 includes a chair 12, a tray 14 and an access device 16. In a preferred practice of this invention tray 14 and access device 16 are detachably mounted to chair 12. Chair 12 includes a seat 18 and a base structure having a plurality of legs 20 which could be interconnected at their lower ends to form a frame or a solid base which would be placed on a suitable support surface such as a floor. Chair 12 also includes a back wall 22 at the back of seat 18 and a pair of side walls 24,24 at opposite sides of seat 18.

In the embodiment of FIGS. 1-4 tray 14 is detachably mounted to chair 12 in any suitable manner. As illustrated the back wall 22 includes a pair of slots 26 into which tongues or downwardly extending hook-like projections 28 on tray 14 would be inserted to mount the tray to the back wall on top of the side walls 24,24. Preferably, the underside of tray 14 would have parallel grooves disposed above the upper edge of side walls 24,24 so that the tray 14 fits snuggly on the side walls.

Figure 4:
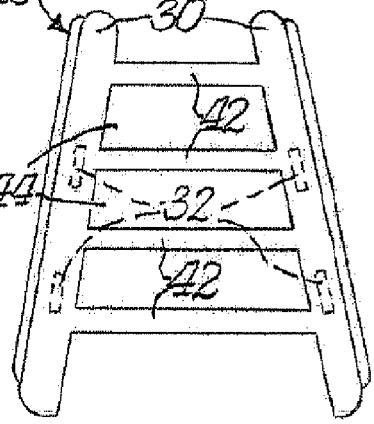
FIG. 4 is a front elevational view of the access device shown in FIGS. 1-2.

Access device 16 is shown in the embodiment of FIG. 4 as a set of stairs which would comprise a ladder having side rails or walls 30. Access device 16 could be mounted to chair 12 in any suitable manner such as is similar to the mounting of tray 14 to chair 12. In that regard, access device 16 includes L-shaped tongues or projections 32 which fit into openings 34 on legs 20,20 at one side of chair 12.

The highchair assembly 10 illustrated in FIG. 14 thus enhances the capability of conventional highchairs. Chair 12 is preferably made approximately the same size as conventional highchairs. Significantly, however, because of the inclusion of access device 16 a small person can climb in and out of chair 12 without help. Although a tray is the preferred practice of the invention, within the broad practices of the invention the highchair could be used without a tray and with or without a strap to hold the child in the chair.

As illustrated, the top 36 of access device 16 terminates at generally the same level or slightly below the side wall 24, as shown in FIG. 1 or at generally the same level as seat 18. The bottom end 38 of access device 16 would terminate generally coplanar with the bottom of legs 20. The legs 20 and bottom end 38 of access device 16 may be provided with anti-slip pads 40 to minimize any tendency of the assembly to slide. Significantly, because the access device 16 would also be on a support surface, the provision of the access device provides further stability to the assembly 10. As a result, when a child, such as in the range of 18 months to 4 years old wishes to climb into or climb out of the chair 12 the child could use the steps 42 for the climbing purposes. By having the added locations where the assembly is against the support surface, there is sufficient stability that the chair 12 would not tend to tip over. In addition, the weight of the child on the access device 16 would tend to move the tongue-like connectors 32 firmly into the holes 34 of chair 12 to prevent the access device from being accidentally detached from the chair 12. Thus, the assembly 10 would give the parent/caregiver an added sense of security while allowing them to continue, for example, preparing a meal thus saving time. Getting some children to eat is also often a problem. The chair assembly 10 would make getting to the dinner table more fun. In addition, the chair assembly would provide the child with a sense of accomplishment and independence.

The following are some of the features of the components of the assembly 10 in the embodiment illustrated in FIGS. 1-4. Where suitable such features could be used in other embodiments.

Where the access device 16 is in the form of a ladder/steps the ladder preferably has three or more steps 42 each of which is about 24 inches wide. Preferably the ladder is completely modular made from plastic which could be smoothly molded at most angles. Ladder 16 has two parallel side rails 30 which would be molded as part of the ladder with slight grooves enabling an easy grip as the ladder is climbed. Such grooves could extend longitudinally on the upper surface and/or under surface of each side rail 30 or could be a series of transverse grooves or ribs spaced down the length of side rails 30 on the upper surface and/or under surface.

Ladder 16 can be easily attached to the main chair 12 on either the right or left side. As illustrated four right-angled ends 32 or connectors are placed through the corresponding four slotted holes 34 on the chair side and then pressed down held by side friction and gravity as the child climbs the ladder/steps. The child places extra weight in the connection point further securing its safe attachment to the chair.

The ladder 16 is inclined and preferably has a shape which follows the general contours of the chair. As noted, anti-slip pads 40 are provided at the base of lower end 38 of the ladder to provide extra support and confirm ladder placement. Preferably ladder 16 includes a rear wall 44 between the adjacent steps 42 that disallow the climber's feet from missing or entering the back of a step. Anti-slip ripples or an anti-slip pad could be secured to or molded into each step.

An advantage of mounting the access device 16 to the side of the highchair 12, unlike step stools or ladders or other types of chairs having steps, relates to the specific chair being a highchair. Because the ladder is mounted to the side there is no interference from the tray 14. By making the ladder removable it is possible to control when the child is permitted to climb out of the highchair or get into the highchair without supervision. If desired, the ladder could be mounted to the back wall, particularly when the back wall is not very high.

Tray 14 could be of any suitable construction including the form of conventional trays. Thus, as shown, for example, in FIG. 7 the tray 14 could have a slight lip 46 around the edges to contain spills, food and toys. The tray could also be provided with spring loaded pins at the tray sides and the bottom of the tray could have parallel grooves that sit firmly on the armrest of the chair sides 24.

Figure 2:
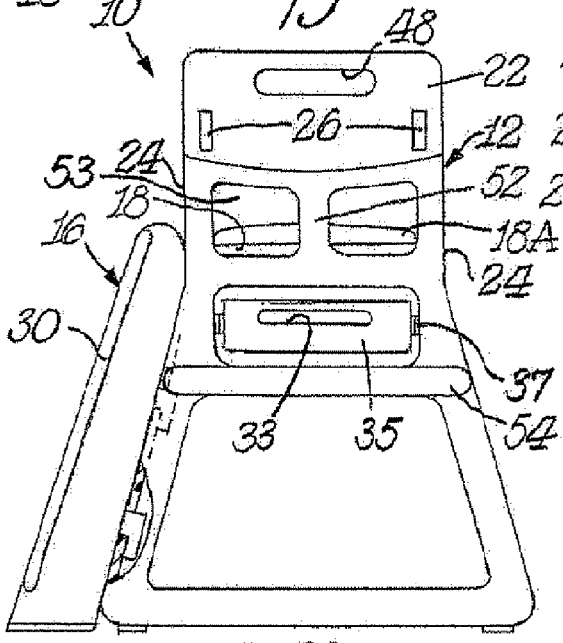
FIG. 2 is a front elevational view partly in section of the invention of FIG. 1 showing the access device attached to the highchair.
Figure 3:
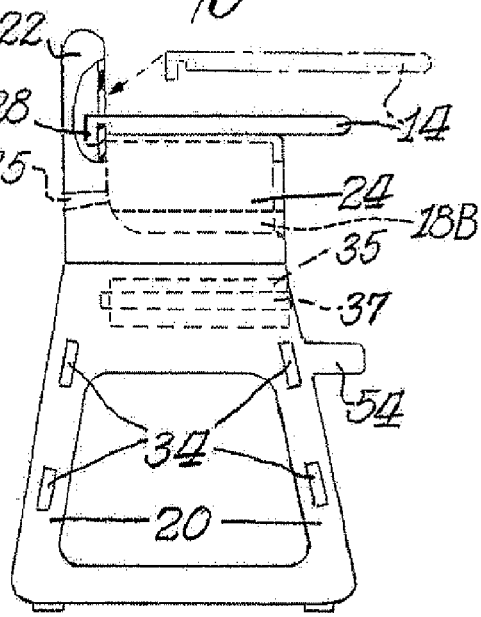
FIG. 3 is a side elevational view partly in section of the highchair shown in FIGS. 1-2.

The chair body could be made of various colors in accordance with a marketing theme. For example, a special polyethylene label could be applied during the molding process using molded-in graphics. The specific graphics would depend on the marketing theme. As shown in FIGS. 1 and 2 the back wall 22 could have a hole 48 to facilitate lifting or positioning of the chair 12. The chair 12 could be formed in various manners and take various shapes. FIGS. 5-9 and 11-12 exemplify some of the shapes and forms for chair 12 which are of modular form. For example, as shown in FIGS. 5-9, a flat U-shaped base 50 at the bottom of legs 20 provides good stability. (FIGS. 1-3 show a four-sided base.) Such U-shape could be about 30 inches square. The chair is connected to the base for seat portion 18 by two large side supports which provide extra stability.

FIGS. 1-4 illustrate one manner of mounting access device 16 to chair 12 through the use of tongues or projections 32 on access device 16 which slide into and are engaged with slots 34 on chair 12. Various other manners of attachment may also be used. FIG. 6, for example, illustrates each side of chair 12 to have a ledge 41. Ledge 41 may have an elongated slot which would be engaged by a downwardly extending projection from access device 16. Alternatively, an upward projection 43 could be located on ledge 41 to engage a corresponding slot in the access device. A further alternative would be to provide an elongated groove across the access device so the access device could be coupled with chair 12 by sliding the access device in a horizontal direction whereupon the ledge 41 would be engaged in the groove.

Having a ledge 41 on each side of the chair provides for symmetry to enhance the appearance of the chair and also provides the option of having the access device mounted to either of the side walls.

Figure 8:
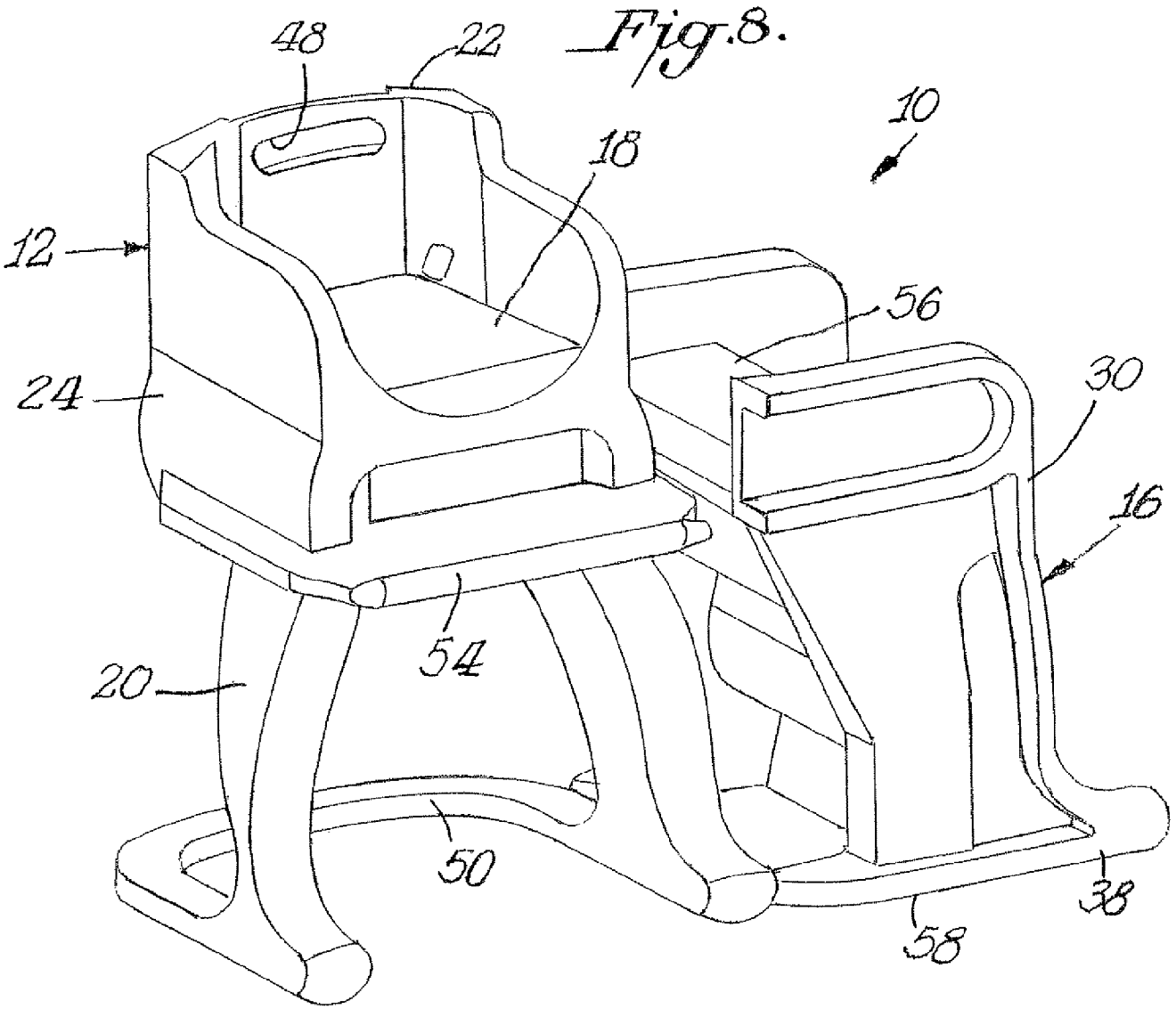
Figure 9:
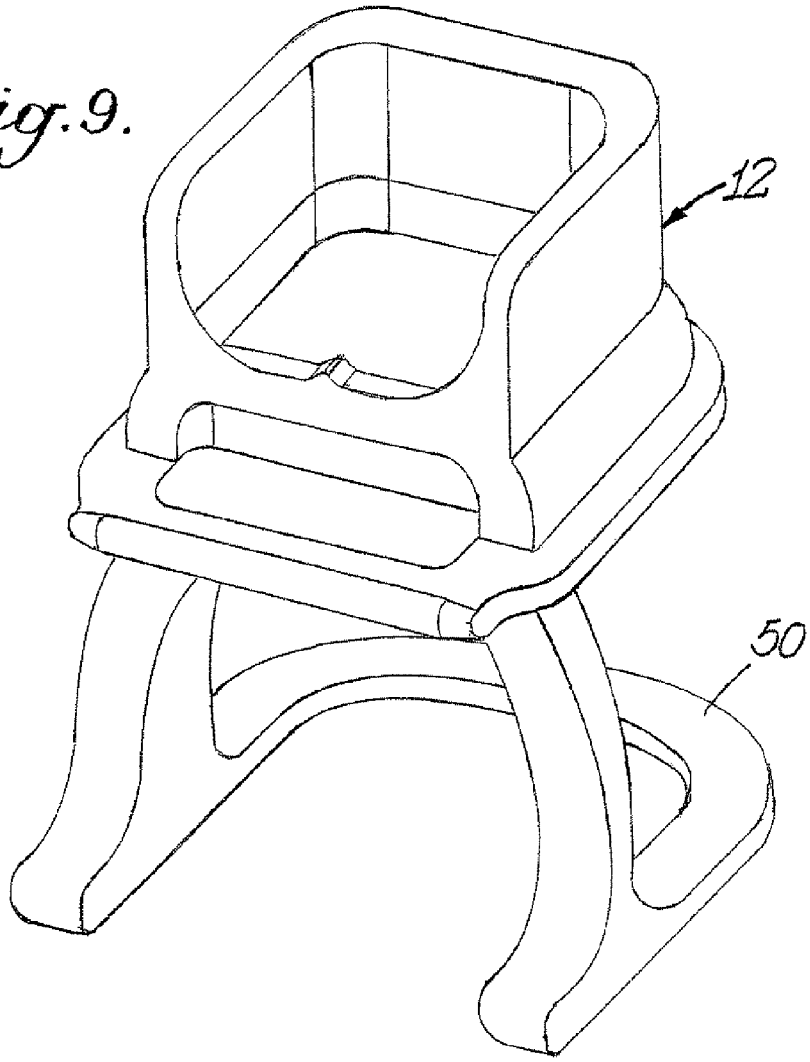

As shown, for example, in FIGS. 7-8 the top step of the ladder may be in the form of a large horizontal platform 56 to provide greater area for the child when entering or leaving the chair.

Figure 5:
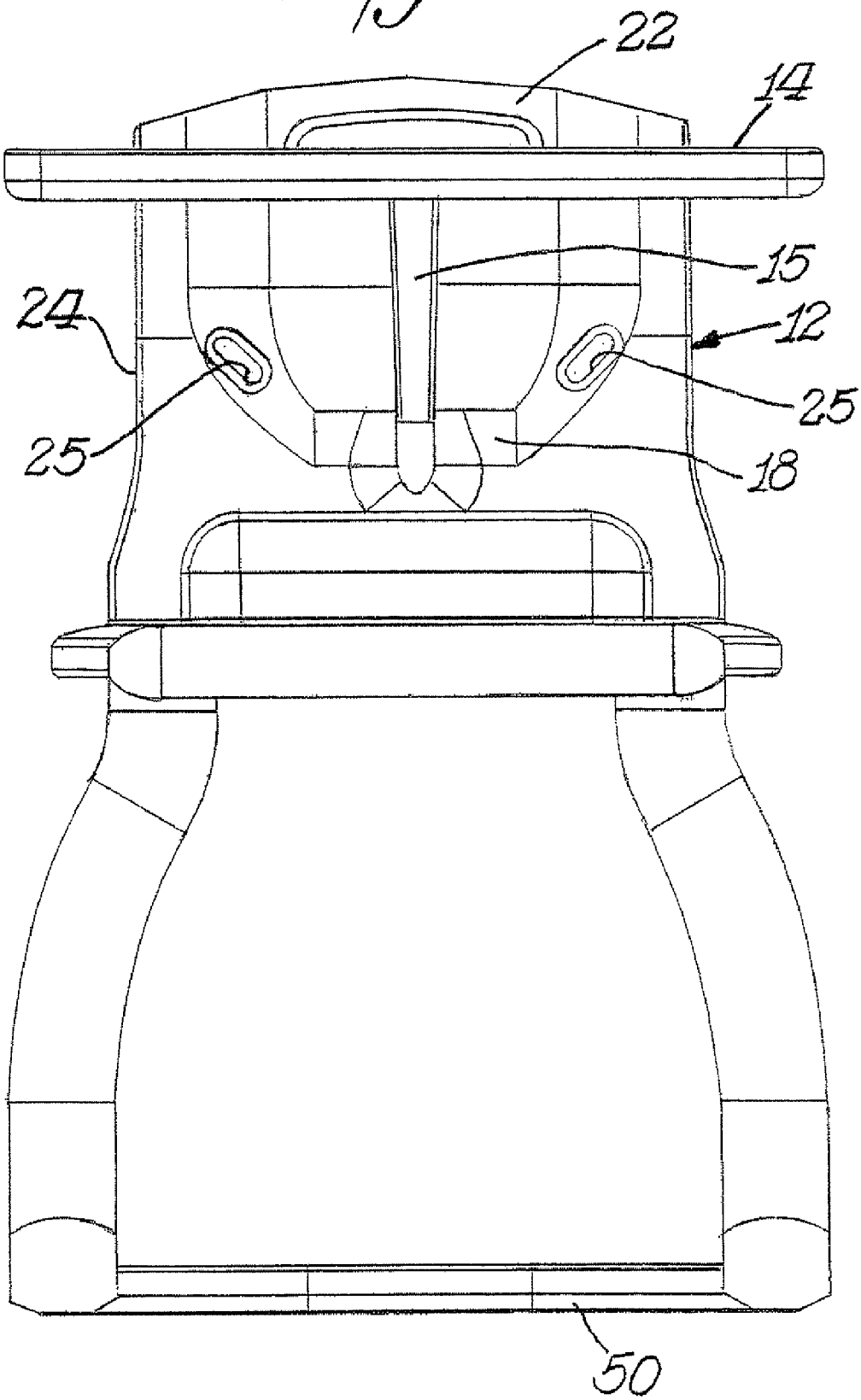
FIG. 5 is a front elevational view of an alternative form of highchair in accordance with this invention.

The chair may include various types of restraining structure. For example, a removable strap could be mounted to the sides 24,24 and/or at the seat back 22. This strap would be used to provide extra safety to younger children who are not using the ladder option. FIG. 5 illustrates slots 25 in back wall 22 for such strap or straps.

Another restraining structure is shown in FIGS. 1-2. A separate T-bar/plastic support 52 is installed in the front seat area of the chair to prevent the child from slipping out of the chair. The front of the chair preferably has a slight ledge 54 or foot rest platform for the child's feet to rest. The generally horizontal top member of the T spans the side walls 24,24, while the vertical member extends downwardly to the seat 18 and centrally at the front edge of seat 18. The top member need only be physically connected to one side wall and the vertical member need not extend completely to the seat. The feet could be inserted through openings 53 resulting from the T-bar support 52 between the vertical member of support 52 and each side wall.

Figure 3A:
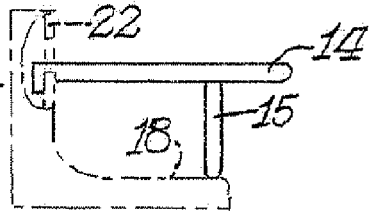
FIG. 3A is a side elevational view showing an alternative tray in accordance with this invention.

In an alternative restraining structure, the tray 14 could include a fin 15 or divider post, such as shown in FIG. 3A, which could extend to the upper surface of seat 18 to prevent the child from slipping out of the chair. Where a fin or stop member, such as fin 15 is used, the fin could extend into a slot in the seat 18 or could simply make contact with the top of seat 18 or could even terminate space slightly above the seat 18. What is important is that the fin should be of sufficient length to prevent the child from sliding out of the chair.

FIG. 6 illustrates a variation of restraining structure where a safety bar 17 which is preferably but not need be rigid, could be detachably mounted across the arms on the upper surfaces of sides 24. The safety bar 17 could include a centrally located downward extension 19 to prevent the child from slipping out of the chair. Such extension 19 could be a rigid bar similar to fin 15 or could be a strap or other flexible member which might be secured in any suitable manner to the top surface of seat 18.

To provide added comfort for a baby or smaller child, seat 18 could be padded or, if desired, a booster seat 18A (partially shown in FIG. 2) could be detachably placed on top of seat 18. The booster seat could be padded or a padded cushion could simply be placed on top of seat 18. The booster seat 18A could take any suitable form such as having a seating area and upstanding side and back walls.

FIG. 3 illustrates the practice of this invention wherein a padded cushion 18B is mounted on the seat.

Where a booster seat or a padded cushion is used, such booster seat or cushion could simply be placed onto and against the chair seat 18. If desired, slots or other fastening structure could be provided for the booster seat and chair to assure a firm engagement of the booster seat or cushion with the chair. The provision of such a booster seat or cushion results in raising the general seating height of the chair and provides added support for smaller children. Alternatively, the booster seat and/or cushion could be mounted in place by providing a groove/rail engagement between the chair and the booster seat or cushion. A further alternative would be to have the booster seat and/or cushion slightly oversized but made of a material that permits it to be pressed into proper position on the chair. A still further option would be to mount the booster seat and/or cushion through the use of straps fed from the back of the chair that travel through the chair and then back again to hold the child in place.

As shown in FIGS. 1-3 a drawer 35 could be provided in chair 12 below seat 18 to store various items. Drawer 35 could be mounted in any suitable manner, such as by the provision of guide tracks 37 shown in phantom in FIG. 3. Drawer 35 could have a handle or opening 33 to facilitate pushing the drawer into and out of its stored condition.

Although FIGS. 1-3 illustrate the drawer 35 to be mounted to the front of the chair 12, such drawer could be disposed for sliding into or out of any of the four sides of the chair. Thus, for example, if the access device is mounted to one of the sides of the chair, the chair could be formed so that the drawer is accessible through the other side or through the back, instead of the front.

As is apparent the chair 12 is preferably of a design to minimize the possibility of tipping over. This is enhanced by the U-shaped base 50, as well as by the mounting of the access device to the chair which adds greater stability. By forming the chair of modular or smoothly molded construction, there are minimal sharp corners. In addition, the chair would be extremely easy to clean.

FIGS. 7-8 show the ladder form of access device 16 to include an enlarged base portion 58 at the lower end 38 of the device 16 to further provide stability.

FIG. 7 also shows a ladder form access device 16 which includes a slot or hole 60 in the platform 58 to facilitate the carrying or handling of the access device 16 or for mounting purposes where, for example, projection 43 on ledge 41 of FIG. 6 is engaged with slot 60.

Although various figures illustrate variations of the chair 12 without having a tray, by suitable modification a tray could be detachably mounted to the chair or could be non-detachably mounted to one side for movement such as by pivoting away from the chair seat and then pivoted back so that a tray would be available for use by the child.

Figure 10:
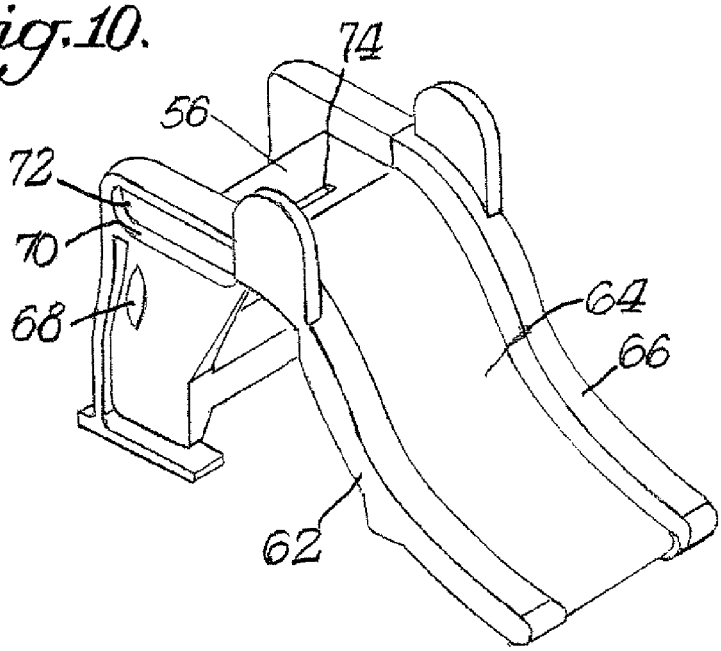

FIG. 10 illustrates an alternative form of access device 62 wherein instead of the device being in ladder form having steps, the device 62 is in the form of a sliding board 64 having a smooth curved downward side adjacent to platform 56. The sliding board would also have side rails 66. The use of a sliding board as an access device is more directed to a child leaving the chair 12 and then sliding down the slide surface 64. Because of the smooth slide surface, the device is not as suitable for the child using the device to climb into the chair.

As illustrated in FIG. 10 the sliding board form of access device could be formed in two separate pieces. One of the pieces would be a support structure 68 which includes the platform 56 at or near its top. Support structure 68 could be mounted to the chair in any way suitable manner, such as by the techniques used for access device 16. As illustrated, the sides of support structure 68 have lateral slots 70 for receiving lateral extensions 72 on the sliding board portion of the device. Further securement could be through use of a hole 74 in the platform 56 into which an upstanding projection on the sliding board would extend. The support structure 62 adds further stability because its base would also rest on the floor.

Figure 13:
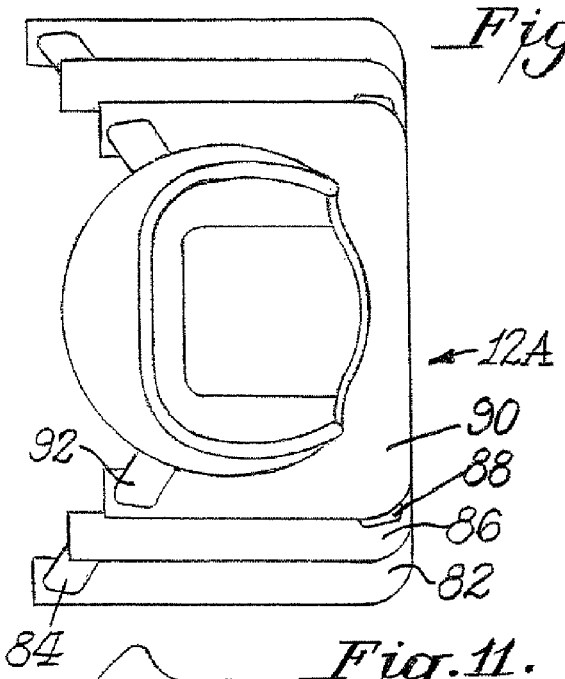
FIG. 13 is a top plan view of the highchair shown in FIGS. 11-12.
Figure 11:
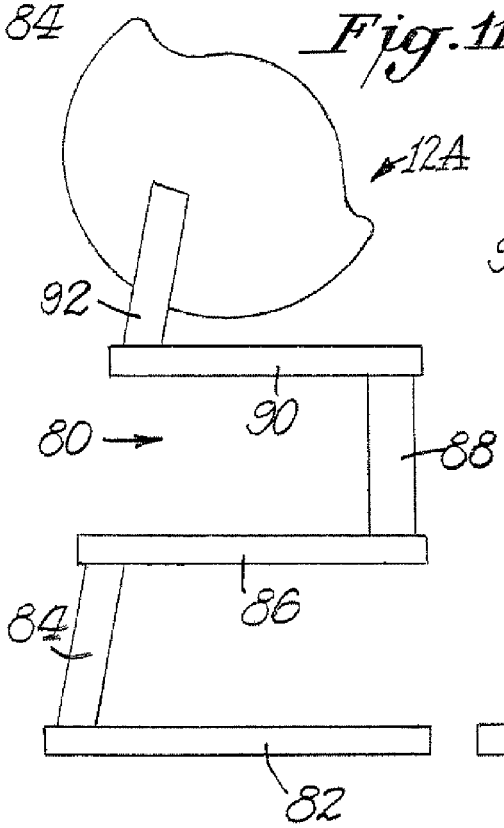
FIG. 11 is a side elevational view of yet another form of highchair in accordance with this invention.
Figure 12:
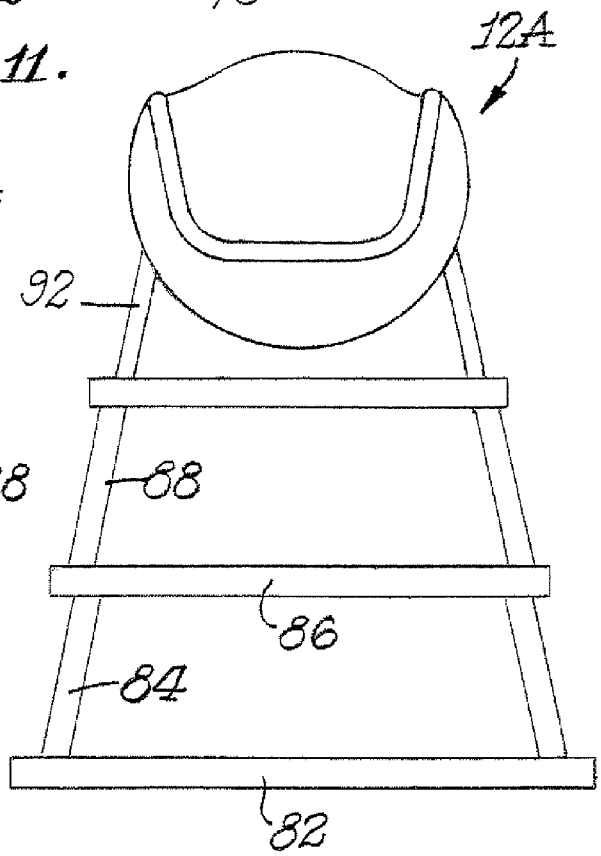
FIG. 12 is a front elevational view of the highchair shown in FIG. 11.

FIGS. 11-13 illustrate a variation in the type of structure that could be incorporated in a highchair to permit a child to have access to the seat. As shown in FIGS. 11-13 a chair 12A is mounted on a support structure 80. Support structure 80 is in the form of a base 82 which could take any suitable shape, such as being U-shaped or a rectangular frame or a completely solid rectangular or other type shape. A support assembly comprising a set of spaced generally vertically but slightly inclined members 84 extends upwardly from base 82 at the rear of base 82. A cantilevered horizontal platform 86 is mounted to supports 84 and extend forwardly of the chair 12A. A further support assembly comprising a set of generally vertical but inclined spaced supports 88 is mounted to platform 86 and support a further platform 90 in cantilevered fashion. An additional set of spaced supports 92 extends upwardly from platform 90 for mounting the chair 12A. The highchair assembly of FIGS. 11-13 is of generally pyramidal shape. Because the platforms 86 and 90 extend forwardly of chair 12A, the platforms 86 and 90 could function as ladder steps. If desired, platform 86 could extend forwardly a greater distance from chair 12A than platform 90 thereby disposing the steps in an inclined manner more along the lines of the steps 42 in access device 16. Although two such platforms 86,90 are illustrated, any suitable number of platforms may be provided.

It is to be understood that the modular form of chair 12A is solely for illustrative purposes and the chair could take any suitable form including the various forms previously described.

The present invention thereby provides a highchair which includes various access structure so as to enhance the desirability of use of the highchair by a child.

It is to be understood that the various features specifically described and illustrated represent preferred and/or illustrative practices of the invention. The invention, however, is not intended to be limited to those specific features. In addition, features included in any particular embodiment may also be included in other embodiments, where appropriate.

What is claimed is:

1. In a highchair assembly having a seat supported by a base structure for being on a support surface, said seat having an upstanding back wall and upstanding opposite first and second side walls, restraining structure at the front of said seat opposite said back wall whereby when a child is sitting on said seat the child is surrounded by said back wall and said first and second side walls and said restraining structure, the improvement being in an access device attached to said seat at a location displaced from said restraining structure, said access device having an upper end located generally at said seat, said access device having a lower end at a same level as a lower end of said base structure for placement on a support surface, and said access device being detachably secured to said seat for selective use of said access device and for selective detachment of said access device from said seat.

2. The assembly of claim 1 wherein said access device is secured to one of said side walls, and said access device includes a plurality of steps.

3. The assembly of claim 2 wherein said steps are in the form of a ladder having at least three vertically spaced steps, and said ladder includes a side rail mounted on each side of said steps.

4. The assembly of claim 1 wherein said restraining structure includes a tray mounted at said front of and above said seat, and a fin mounted to said tray and extending downwardly toward said seat generally centrally at said front of said seat.

5. The assembly of claim 1 wherein said restraining structure includes a bar mounted to one of said side walls and extending toward the other of said side walls, and a stop member mounted to said bar and extending downwardly toward said seat generally centrally at said front of said seat.

6. The assembly of claim 1 wherein said restraining structure includes a T-bar mounted at said front of said seat, said T-bar having an upper cross member extending toward said side walls and a downwardly extending vertical member extending toward said seat, and a leg opening being formed between each of said side walls and said vertical member.

7. The assembly of claim 1 wherein said base structure includes a foot rest platform mounted below and forwardly of said seat, and a set of strap holes in said back wall through which a strap may be inserted to restrain a child in said seat.

8. The assembly of claim 1 including a drawer slidably mounted below said seat.

9. The assembly of claim 1 wherein said restraining structure includes a tray detachably mounted at the front of and above said seat.

10. The assembly of claim 1 wherein a booster seat is mounted on said seat.

11. The assembly of claim 1 wherein a padded cushion is mounted on said seat.

12. The assembly of claim 1 wherein said access device is secured to said seat by being detachably mounted to one of said back wall and said side walls.

13. In a highchair assembly having a seat supported by a base structure for being on a support surface, said seat having an upstanding back wall and opposite first and second side walls, the improvement being in an access device attached to one of said walls, said access device having an upper end located generally at said one wall, said access device having a lower end for placement on a support surface, wherein said access device is detachably secured to one of said side walls, said access device includes a plurality of steps, wherein said steps are in the form of a ladder having at least three vertically spaced steps, said ladder includes a side rail mounted on each side of said steps, said ladder is inclined and includes a solid back connecting adjacent of said steps to each other, and said ladder includes a generally horizontal platform at its top.

14. The assembly of claim 1 wherein said seat and said base structure are molded in modular form.

15. The assembly of claim 14 wherein said base structure includes a plurality of legs, and a generally U-shaped base mounted to the bottom of said legs.

16. In a highchair assembly having a seat supported by a base structure for being on a support surface, said seat having an upstanding back wall and upstanding opposite first and second side walls, restraining structure at the front of said seat opposite said back wall whereby when a child is sitting on said seat the child is surrounded by said back wall and said first and second side walls and said restraining structure, the improvement being in an access device attached to one of said walls at a location displaced from said restraining structure, said access device having an upper end located generally at said one wall, said access device having a lower end for placement on a support surface wherein an outwardly extending ledge being mounted to each of said side walls for selectively mounting said access device to either of said side walls, and said access device being detachably mounted to one of said side walls.

17. The assembly of claim 16 wherein said access device is in the form of a sliding board mounted to one of said side walls.

18. The assembly of claim 17 wherein said sliding board is detachably mounted to a support structure which is detachably mounted to said side wall, said sliding board including side rails, and a generally horizontal platform being mounted to the upper end of said support structure.

* * * * *